United States Patent [19]

Franz

[11] 4,272,017

[45] Jun. 9, 1981

[54] METHOD AND NOZZLE ASSEMBLY FOR FLUID JET PENETRATION OF A WORK MATERIAL

[76] Inventor: Norman C. Franz, Apt. 1203-4665 W. Tenth Ave., Vancouver, Britsh Columbia, Canada

[21] Appl. No.: 669,301

[22] Filed: Mar. 22, 1976

[51] Int. Cl.[3] ..... B26F 1/26

[52] U.S. Cl. ..... 239/1; 83/53; 83/177; 239/288.5; 299/17

[58] Field of Search ..... 239/1, 288, 288.3, 288.5, 239/596, 600, 601; 299/16, 17; 83/22, 24, 53, 177, 743, 744, 745, 925 R; 166/305 R; 175/65, 67, 72; 51/317

[56] References Cited

U.S. PATENT DOCUMENTS

| | | | |
|---|---|---|---|
| 2,587,243 | 2/1952 | Sweetman | 83/53 X |
| 2,985,050 | 5/1961 | Schwacha | 83/53 |
| 3,140,713 | 7/1964 | Ismach | 239/288.5 X |
| 3,212,378 | 10/1965 | Rice | 83/53 |
| 3,524,367 | 8/1970 | Franz | 83/53 |
| 3,672,380 | 6/1972 | Schuster | 239/288.5 X |
| 3,877,334 | 4/1975 | Gerber | 83/53 X |
| 3,891,157 | 6/1975 | Justus | 83/53 X |

*Primary Examiner*—Andres Kashnikow
*Attorney, Agent, or Firm*—Ian C. McLeod

[57] ABSTRACT

A method for improved penetration of a work material using a high velocity fluid jet from a nozzle element by providing a sealed chamber between a surface of the work material and the nozzle element is described. With hard and/or irregular materials, a deformable element is provided between the nozzle element and the work surface so that the deformable element conforms to the surface to effect the seal. A preferred nozzle element assembly including the deformable element is also described. The method is particularly adapted to mining operations such as coal, hard rock excavation, and wood impregnation.

8 Claims, 5 Drawing Figures

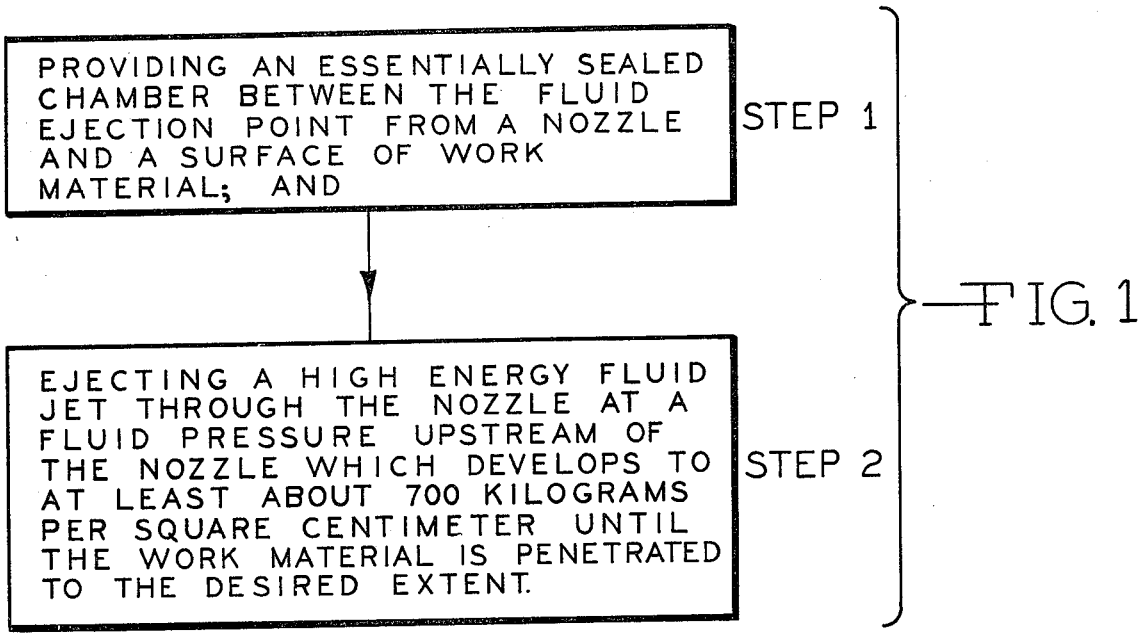
FIG. 1
FIG. 2
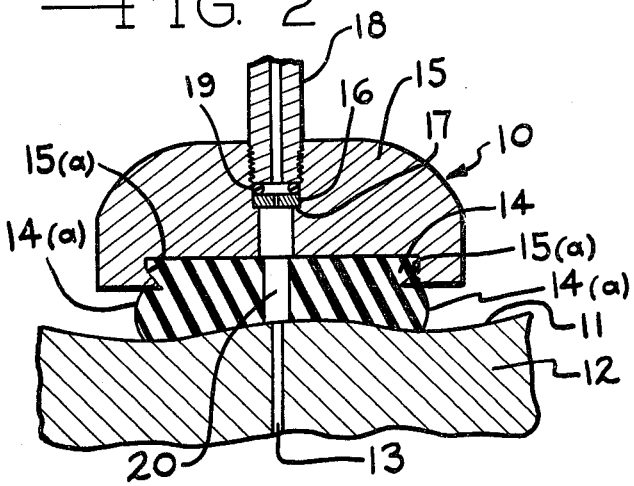
FIG. 3
(PRIOR ART)
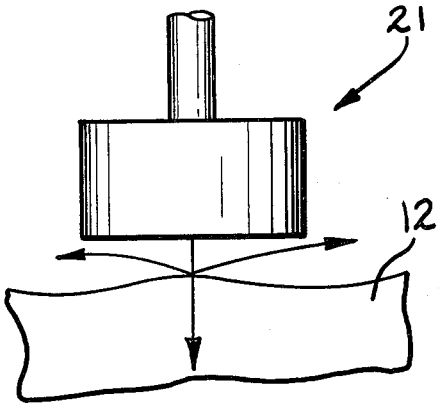
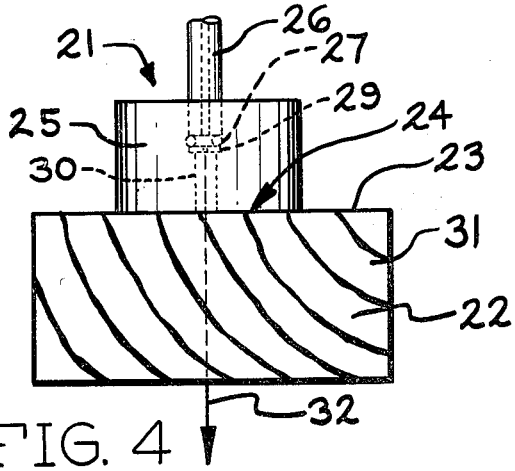
FIG. 4
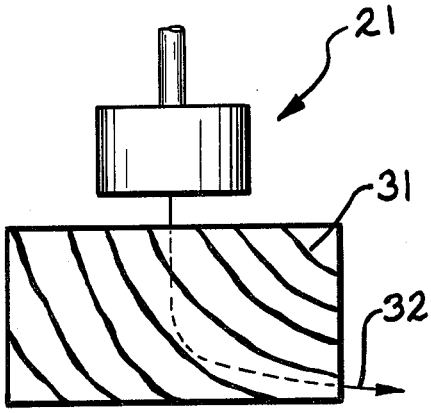
FIG. 5
(PRIOR ART)

METHOD AND NOZZLE ASSEMBLY FOR FLUID JET PENETRATION OF A WORK MATERIAL

SUMMARY OF THE INVENTION

The present invention relates to the method and nozzle assembly for producing an improved high velocity jet. More particularly the present invention relates to a method for producing a high velocity jet which more rapidly and/or effectively penetrates a work material.

PRIOR ART

High velocity fluid jets (above about 10,000 psi or 700 kg per sq cm fluid ejection pressure) are well known to those skilled in the art and have found significant commercial usage. My U.S. Pat. Nos. 3,524,367; 3,532,014; 3,705,693; 3,851,899 and 3,750,961 describe methods and nozzle assemblies for producing such jets.

In general it has been found that it is important to have a standoff distance of between 5 and 500 nozzle diameters between the ejection point from the fluid jet nozzle and a surface of the work material in order to develop good penetration. As a result there tends to be considerable splashback from the surface as the jet penetrates the material. Further, with thick cross-sectioned and/or irregularly textured materials, the jet rapidly begins to wander away from its longitudinal axis after penetration. Further still, where the surface of the work material is hard and irregular, the surface tends to deflect and dissipate the energy of the jet.

It is therefore an object of the present invention to provide a method and nozzle assembly which eliminates jet splashback and which tends to maintain the jet on its axis as it penetrates the work piece. It is further an object of the present invention to provide a method and nozzle assembly which allows for penetration along the axis of the jet into a surface of a work material which is slanted in a plane which is not perpendicular to the axis of the jet. Further still it is an object of the present invention to provide a nozzle assembly which is simple and inexpensive to construct. These and other objects will become increasingly apparent by reference to the following description and the drawing.

IN THE DRAWING

FIG. 1 is a schematic diagram of the method of the present invention.

FIG. 2 is a cross-sectional front view of a preferred nozzle assembly compressed into contact with an irregular hard work material surface and particularly illustrating a deformable element sealed around and below the nozzle fluid ejection point and in sealed contact with a surface of the work material.

FIG. 3 is a front view of a conventional prior art nozzle assembly illustrating the splashback of the fluid jet when penetrating a work material.

FIG. 4 is a front view of a nozzle holder particularly illustrating a lower flat surfaces of the holder pressed against a smooth surface of wood work material so as to form a sealed chamber to improve the depth of penetration of the jet.

FIG. 5 is a front view of a conventional prior art nozzle holder adjacent a work material surface with a standoff distance as conventionally used and particularly illustrating the wandering of the jet from its longitudinal axis.

GENERAL DESCRIPTION

The present invention relates to an improvement in the method of penetrating a work material with a high energy fluid jet ejected from a nozzle element which comprises: providing an essentially sealed chamber between the fluid ejection point from the nozzle element and a surface of the work material; and ejecting a high energy fluid jet through the nozzle at a fluid pressure upstream of the nozzle which develops to at least about 700 kilograms per square centimeter (10,000 psi) until the work material is penetrated to the desired extent. Preferably the sealed chamber is provided in part by a deformable element with a tubular opening forming part of the chamber compressed between the nozzle element below the fluid ejection point and the work material.

The present invention also relates to an improved fluid jet nozzle element for penetrating a work material which comprises: a rigid nozzle element with a fluid exit point for a high velocity fluid jet; and a deformable element with a tubular opening adjacent and surrounding the exit point of the nozzle element for positioning in contact with a surface of the work material to form a sealed chamber. Preferably the deformable element is composed of an elastomer.

FIG. 2 shows a nozzle assembly 10 according to the present invention in contact with a surface 11 of a work material 12 wherein a hole 13 (shown as enlarged) has been penetrated into the material 12 by a high velocity fluid jet. A deformable element 14 is compressed against the surface 11 in order to provide a seal. In the nozzle assembly 10 shown in FIG. 2, the deformable element 14 is supported by a holder 15 having an annular lip 15(*a*) for holding the resilient element 14 in place. A bulge 14(*a*) is formed on the deformable element 14 due to compressing the assembly 10 against the work surface 11. Thus a sealed chamber 20 is formed to confine the fluid jet prior to penetration of the material 12.

A sapphire nozzle 16 is mounted in a metal casing (not shown) which bears on a shoulder 17 of the holder 15. A fluid inlet conduit 18 leads into the holder 15 in contact with an annular elastic ring 19 so as to compress the ring 19 onto the sides of the casing for nozzle 16 to seal the nozzle 16 from leakage.

The deformable element 14 has sufficient strength to seal the chamber 20 when subjected to the fluid pressure from the jet during penetration of the work material 12. A ring seal or a cylindrical tube of a deformable material functions satisfactorily. As shown hereinafter in the Examples, a tube of deformable material where the outside walls are unsupported will function satisfactorily.

FIG. 3 shows a prior art nozzle assembly 21 which is similar to that in FIG. 2 except that the deformable element 14 is not present. The nozzle assembly 21 is described in detail in FIG. 4. As the jet pierces a hard work surface such as encountered in mining the jet splashes away from the surface. Also penetration time is greater with certain materials.

FIG. 4 shows the nozzle assembly 21 of FIG. 3 in detail wherein a material 22, particularly wood, which has a deformable surface 23 and which is soft enough to form a fluid seal with the smooth end 24 of a metal holder 25. An inlet conduit 26, nozzle ring seal 27 and nozzle 29 are provided mounted as shown in FIG. 4. A sealed chamber 30 is provided in this manner for penetrating the surface 23 of the material 22 by compressing the surface 24 of the holder 25 against the material 22 surface 23. Straight penetration by the jet 32 is achieved. As shown in FIG. 5, where wood is to be pierced at an angle to the annular rings 31 with a conventional standoff of the nozzle assembly 21, the result is that the jet 32 will wander away from the axis of penetration using the prior art method.

The seal in the chambers 20 or 30 that is formed does not have to be perfect and can allow for minor leakage of fluid. However, as will be apparent to those skilled in the art, the enhanced penetration effect is lost if there is substantial fluid leakage.

In the nozzle assembly of the present invention, there is preferably a standoff distance of between 5 and 200 nozzle diameters between the surface of the work material and the nozzle fluid ejection point. The nozzle usually is circular in cross-section and has a diameter between about 0.002 and 0.100 inch (0.05 and 2.5 mm).

Where a tubular deformable element is provided forming the chamber between the nozzle holder and the surface of the work material, the opening in the deformable element has a length, along with the portion of the holder below the nozzle exit, which corresponds to the standoff distance. Preferably the thickness of the tubular deformable element is between about 1 to 5 cm. The tubular deformable element has an opening having a width of at least the diameter of the nozzle opening up to about one inch (2.5 cm).

The deformable element is preferably made of a resilient elastomer such as rubber for ease of sealing with rough, hard surfaces, although a tetrafluoroethylene polymer with a low coefficient of friction can be used where there is to be sliding contact with the work surface subsequent to piercing. The clamping pressure on the deformable element is usually at least about 20 psi (1.4 kg/sq cm) for a resilient elastomer. More clamping pressure would be required for a deformable metal seal.

SPECIFIC DESCRIPTION

The following Examples specifically illustrate the method of the present invention in contrast to the prior art.

EXAMPLE 1

The apparatus used in this Example is similar to that illustrated in FIGS. 2 and 3, except that a rubber stopper was pressed between the nozzle holder and the work surface. The prior art method of FIG. 3 was tried first.

The material to be pierced was quartzite, approximately $\frac{5}{8}$ inch (1.59 cm) in thickness with a standoff of $\frac{3}{4}$ inch (1.9 cm) between the nozzle holder and the work surface. Using ordinary filtered tap water, a 0.010 inch (0.0254 cm) diameter sapphire nozzle, and building pressure from 0 to 40,000 psi (0 to 2800 kg per sq cm) maximum, the time to reach full pressure being approximately 8 seconds, the jet was directed at the quartzite for a period of 1 minute. After this interval of time, the jet either did not pierce through the work or just broke through after the one minute period.

Using the apparatus similar to FIG. 2, with an ordinary laboratory black rubber stopper one inch (2.54 cm) in thickness and having a one inch (2.54 cm) diameter, compressed between the work and the nozzle holder, the average time required for piercing the rubber and quartzite was only 12 seconds, representing a very large improvement (about five times) in the speed of piercing. The jet was allowed to initially penetrate the rubber stopper in this Example although this is unnecessary. The clamping pressure on the stopper was about 10 psi (0.7 kg/cm) and there was very little leakage from the chamber.

EXAMPLE 2

Example 1 was repeated on a piece of lead $\frac{1}{2}$ inch (1.27 cm) in thickness using the apparatus of FIG. 3 and after one minute the jet did not pierce through the lead, although a small bubble was apparent on the underside in some cases. When the rubber stopper was inserted as in Example 1, the $\frac{1}{2}$ inch (1.27 cm) thickness was pierced within 15 seconds. In this Example, the jet without the sealed chamber would not even penetrate the work piece since the latter was soft enough to deflect the jet without being pierced.

EXAMPLE 3

Repetition of Example 1 on a sheet of $\frac{1}{4}$ inch (0.63 cm) hard aluminum plate seemed to show no particular speed advantage with the rubber stopper, however the hole was larger and more uniform in cross-section and there was no splashback.

EXAMPLE 4

Using a block of Douglas fir wood, $3\frac{1}{2}$ inches (8.75 cm) in thickness, with a distance of approximately $\frac{1}{4}$ inch (0.63 cm) between the nozzle holder and the work surface, the jet was directed at the wood using the prior art method as shown in FIG. 5. The growth ring orientation in the block was at an angle as indicated in FIG. 5, and the jet pierced the block for a distance of about $\frac{3}{4}$ inch (1.9 cm) and was then deflected along the softer portion of the growth rings, and shot out the side of the block at a distance of approximately $1\frac{1}{2}$ inches (3.8 cm), a few seconds after full pressure of 40,000 psi (2800 kg per sq cm) was reached.

When the method was repeated with the nozzle pressed at a pressure of about 20 psi (1.4 kg/sq cm) in clamping contact with the work surface as shown in FIG. 4, thus eliminating the air gap and forming the sealed chamber 30, the block was pierced to its full depth cleanly and neatly in less than 9 seconds. It was observed that full pressure of the jet had not yet been reached. This indicates that a lower fluid pressure can be used to obtain complete penetration using the method of the present invention.

As can be seen from the foregoing Examples, the penetration by the high velocity jet is much straighter and faster using the sealed chamber. The apparatus is particularly important in the mining of mineral materials using the deformable element to form a seal with an irregular work material. It is also significant for piercing and impregnating materials such as wood.

I claim:

1. A method of penetrating a work material with a high energy fluid jet ejected from a nozzle element comprising the steps of:

(a) addressing the nozzle element to the work material through a chamber interpositioned between a fluid ejection point of the nozzle element and a surface of the work material;

(b) forcing the chamber into a compressed engagement with said work material surface, to cause said chamber to be compressively and substantially sealed against said surface; and (c) ejecting a high energy fluid jet through the nozzle element, and in throughgoing traverse of said chamber, at a fluid pressure upstream of the nozzle element which develops to at least about 700 kilograms per square centimeter until the work surface is penetrated to the desired extent; wherein said through-chamber addressing step comprises disposing a deformable element having a tubular opening formed therein between the nozzle element and the surface of the work material.

2. The method of claim 1 further including the step of providing a standoff distance between the nozzle element fluid ejection point and the surface of the work material of between about 2 and 500 nozzle diameters.

3. The method of claim 1 wherein said jet ejecting step comprises discharging said jet through a circular opening in said nozzle element which has a diameter of between about 0.05 and 2.5 mm.

4. The method of claim 1 wherein said through-chamber addressing step comprises addressing the nozzle element, through the interpositioned chamber, to a hard work material.

5. The method of claim 1 wherein said through-chamber addressing step comprises addressing the element, through the interpositioned chamber, to a smooth work material; and further including the step of effecting relative movement between said nozzle element and said work material, while maintaining the interpositioned chamber in forced, compressed engagement with the work material surface, following said desired-extent penetration of said surface.

6. A method of penetrating a work material with a high energy fluid jet ejected from a nozzle element comprising the steps of:

(a) addressing the nozzle element to the work material through a chamber interpositioned between a fluid ejection point of the nozzle element and a surface of the work material;

(b) forcing the chamber into a compressed engagement with said work material surface, to cause said chamber to be compressively and substantially sealed against said surface; and (c) ejecting a high energy fluid jet through the nozzle element, and in throughgoing traverse of said chamber, at a fluid pressure upstream of the nozzle element which develops to at least about 700 kilograms per square centimeter until the work surface is penetrated to the desired extent; wherein said through-chamber addressing step comprises providing a holder, having a tubular opening, for holding the nozzle element, and providing a deformable element also having a tubular opening formed therein; and interposing said deformable element between the work material and the holder, with the tubular opening in the deformable element aligned with the tubular opening in the holder so that both said tubular openings together define said chamber.

7. A method of penetrating a work material with a high energy fluid jet ejected from a nozzle element comprising the steps of:

(a) addressing the nozzle element to the work material through a chamber interpositioned between a fluid ejection point of the nozzle element and a surface of the work material;

(b) forcing the chamber into a compressed engagement with said work material surface, to cause said chamber to be compressively and substantially sealed against said surface; and (c) ejecting a high energy fluid jet through the nozzle element, and in throughgoing traverse of said chamber, at a fluid pressure upstream of the nozzle element which develops to at least about 700 kilograms per square centimeter until the work surface is penetrated to the desired extent; wherein said through chamber addressing step comprises addressing the element, through the interpositioned chamber, to a smooth work material; and further including the step of effecting relative movement between said nozzle element and said work material, while maintaining the interpositioned chamber in forced, compressed engagement with the work material surface, following said desired-extent penetration of said surface; and said through-chamber addressing step further comprises disposing a deformable element, having a low coefficient of friction, between the nozzle element and the work material surface.

8. A method of penetrating a work material with a high energy fluid jet ejected from a nozzle element comprising the steps of:

(a) addressing the nozzle element to the work material through a chamber interpositioned between a fluid ejection point of the nozzle element and a surface of the work material;

(b) forcing the chamber into a compressed engagement with said work material surface, to cause said chamber to be compressively and substantially sealed against said surface; and (c) ejecting a high energy fluid jet through the nozzle element, and in throughgoing traverse of said chamber, at a fluid pressure upstream of the nozzle element which develops to at least about 700 kilograms per square centimeter until the work surface is penetrated to the desired extent; wherein said through-chamber addressing step comprises addressing the element, through the interpositioned chamber, to a smooth work material; and further including the step of effecting relative movement between said nozzle element and said work material, while maintaining the interpositioned chamber in forced, compressed engagement with the work material surface, following said desired-extent penetration of said surface; and said through-chamber addressing step further comprises disposing a deformable element, composed of a tetrafluoroethylene polymer, between the nozzle element and the work material.

* * * * *